US005803254A

United States Patent [19]

Vasudeva

[11] Patent Number: 5,803,254

[45] Date of Patent: Sep. 8, 1998

[54] TOOL CASE WITH MULTIPLE STORAGE COMPARTMENTS

[75] Inventor: Kailash C. Vasudeva, Waterloo, Canada

[73] Assignee: Maxtech, Inc., Roseville, Mich.

[21] Appl. No.: 837,322

[22] Filed: Apr. 11, 1997

[51] Int. Cl.[6] ..... B65D 85/00

[52] U.S. Cl. ..... 206/373; 206/379; 220/504

[58] Field of Search ..... 206/349, 372–379; 220/503–505, 521, 528

[56] References Cited

U.S. PATENT DOCUMENTS

| | | | |
|---|---|---|---|
| 3,061,136 | 10/1962 | Sterngart | 220/504 |
| 4,191,291 | 3/1980 | Brown | 206/379 |
| 4,807,760 | 2/1989 | Sussman | 220/503 |
| 5,114,007 | 5/1992 | Chen | 206/373 |
| 5,429,235 | 7/1995 | Chen | 206/372 |
| 5,520,400 | 5/1996 | Hung | 206/373 |
| 5,526,929 | 6/1996 | Wei | 206/372 |

*Primary Examiner*—B. Dayoan
*Assistant Examiner*—Luan K. Bui
*Attorney, Agent, or Firm*—R. Craig Armstrong

[57] ABSTRACT

The tool case provides storage compartments which may be used by the purchaser to store additional items which might be employed in conjunction with the tools stored in the tool case. The underside of the box portion of the tool case is recessed and a number of containers are pivotably mounted within the recess to provide the user with multiple storage compartments. The containers are all connected to a gang bar to allow them to pivot in unison from a closed position to an open position. When the containers are in the closed position, their outer faces form a single plane which is flush with and parallel to the bottom of the box portion, allowing the user to place rest the bottom of the case securely on a work table or other flat surface. When the containers are in an open position, the outer face of each container projects outwardly exposing the opening and thus allowing the user to place items into or remove items from the containers.

4 Claims, 7 Drawing Sheets

TOOL CASE WITH MULTIPLE STORAGE COMPARTMENTS

BACKGROUND OF THE INVENTION

1. Field of the Invention

This invention relates to a tool case, particularly of the type used to display a tool set at the point of sale, and to subsequently store the tool set. Such tool cases are commonly referred to as "gift cases".

Cases of the general type are well known, and typically include a base in the form of an open-topped box, and a lid hinged or otherwise mated with the box portion, with a clip or other means to hold the lid shut. The case typically also contains a panel with a number of recesses to accommodate various tools and components, such as a screwdriver and various bits therefor, for example.

However, this conventional configuration does not efficiently use the available space in the case because a large volume of unused space is left between the panel and the bottom of the box portion of the case.

SUMMARY OF THE INVENTION

In view of the above, it is an object of the invention to provide an improved tool case with storage compartments which are accessed from the bottom of the box portion. These compartments may be used by the purchaser to store additional items which might be employed in conjunction with the tools stored in the tool case.

In the invention, the bottom surface of the tool case base is recessed, and a number of containers are fitted within the recess to provide the user with multiple storage compartments. The containers are pivotably mounted inside the recess and are all connected to gang bars to allow them to pivot in unison from a closed position to an open position. When the containers are in the closed position, their faces form a single plane which is flush with the bottom of the base, allowing the user to rest the bottom of the case securely on a work table or other flat surface. To access the storage containers, the user rests the case on its lid and pivots the containers to the open position, thus causing a face of each container to project outwardly, exposing the opening. The user may then remove items from the storage containers.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
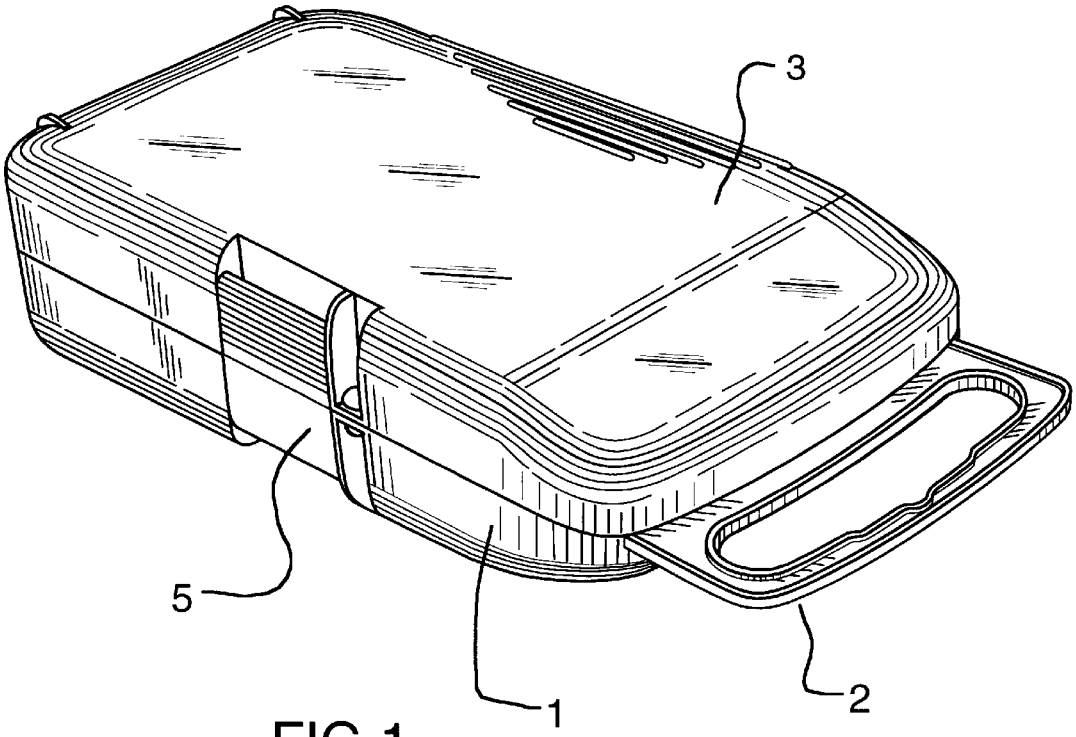
FIG. 1 is a perspective view looking down on the lid of the tool case.
Figure 2:
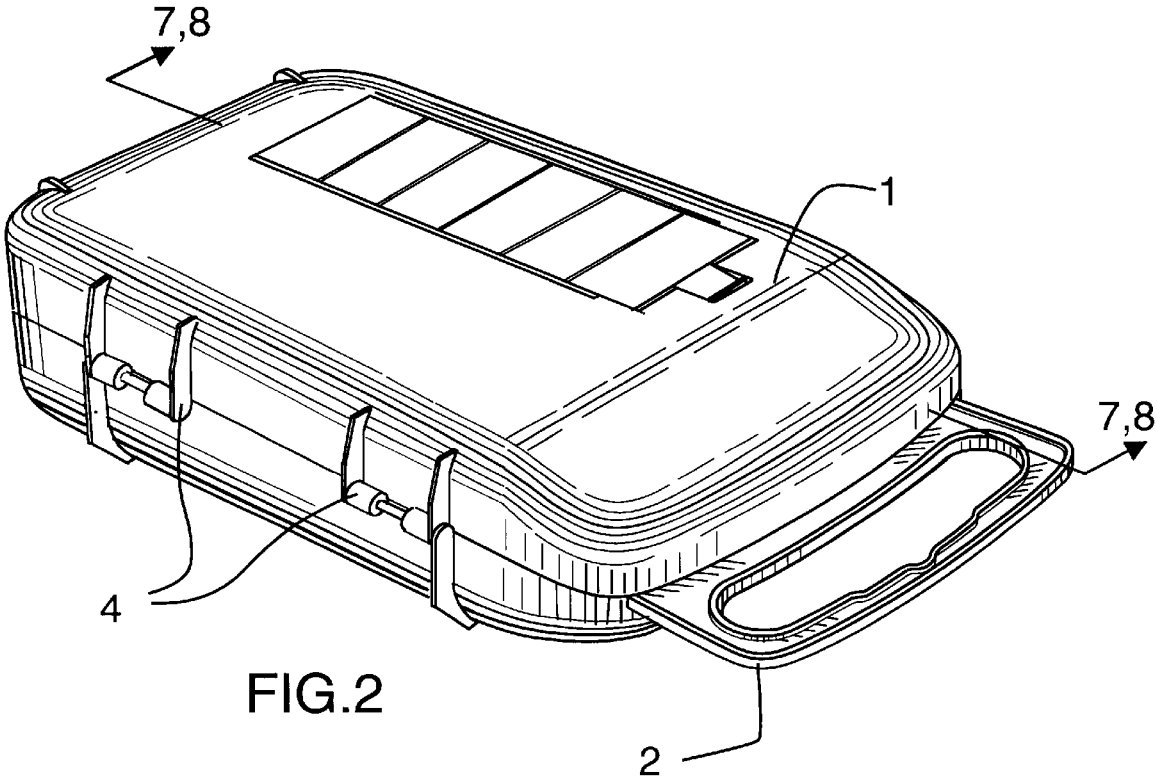
FIG. 2 is a perspective view looking down on the bottom of the box portion of the tool case.

Referring to the drawings, FIG. 1 shows the tool case which includes a main box portion 1 with a handle 2, molded from a single piece of plastic, and a preferably transparent plastic lid 3. A conventional plastic clip 5 holds the lid in a closed position, although any other suitable means to hold the lid in place could be used. FIG. 2 shows that the lid is hinged to the box portion, for example, by two hinges 4.

Figure 3:
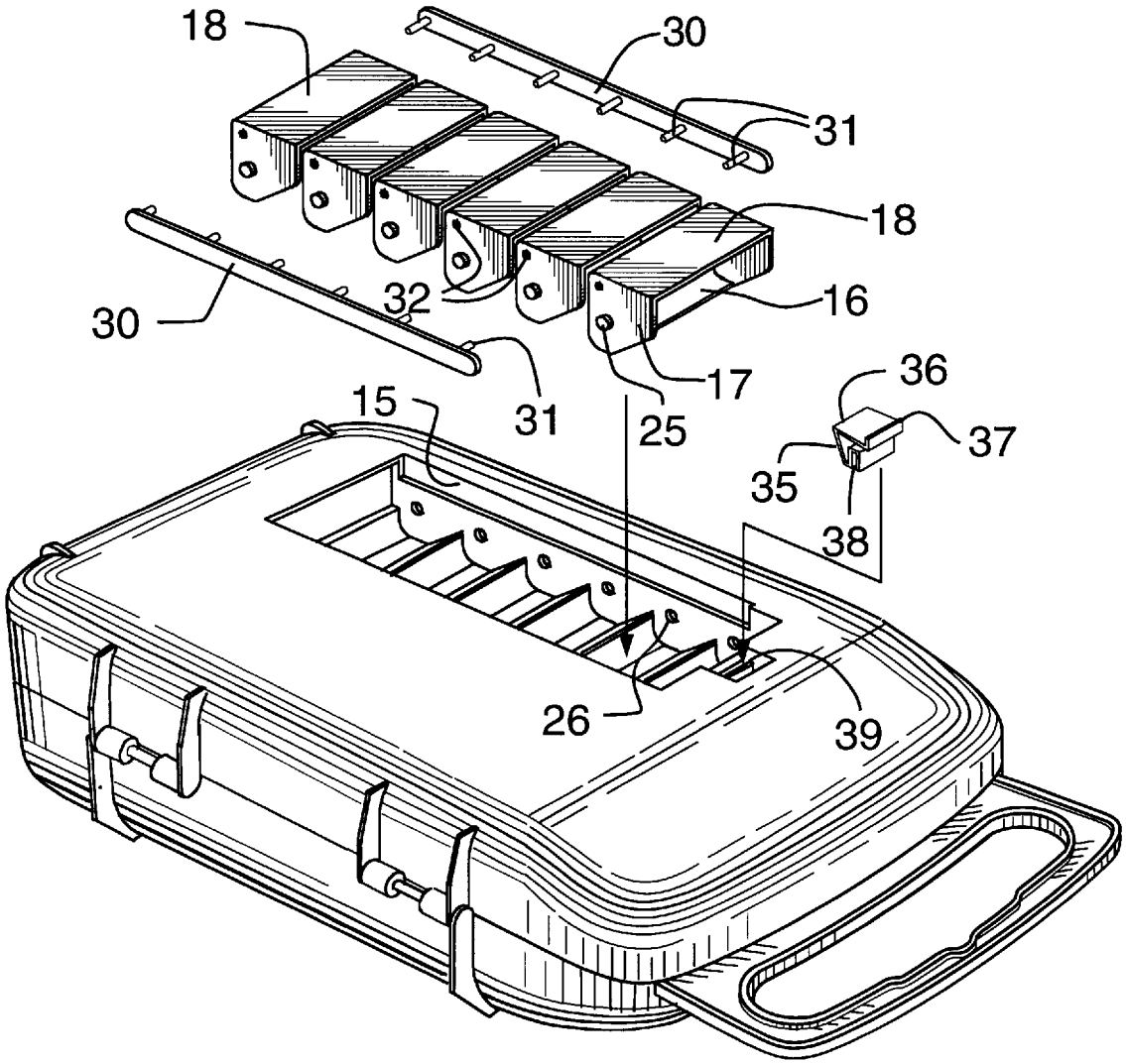
FIG. 3 is an exploded view showing the recess and the storage containers.

FIG. 3 shows the bottom of the box portion which is molded with a recess 15 to accommodate preferably one row of six storage containers 16 pivotably mounted within the recess in a straight line parallel to the sides of the tool case. In the preferred embodiment, the recess containing the storage containers is located within the section of the box portion furthest from the hinges. However, it will be appreciated by one skilled in the art that the storage containers may be positioned in the center of the box portion or in the section of the box portion nearest to the hinges.

Figure 4:
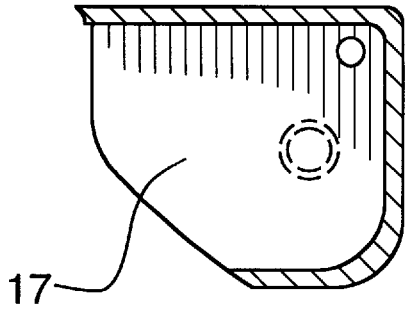
FIG. 4 is a cross-sectional view of a storage container along line 4—4 in FIG. 5.
Figure 5:
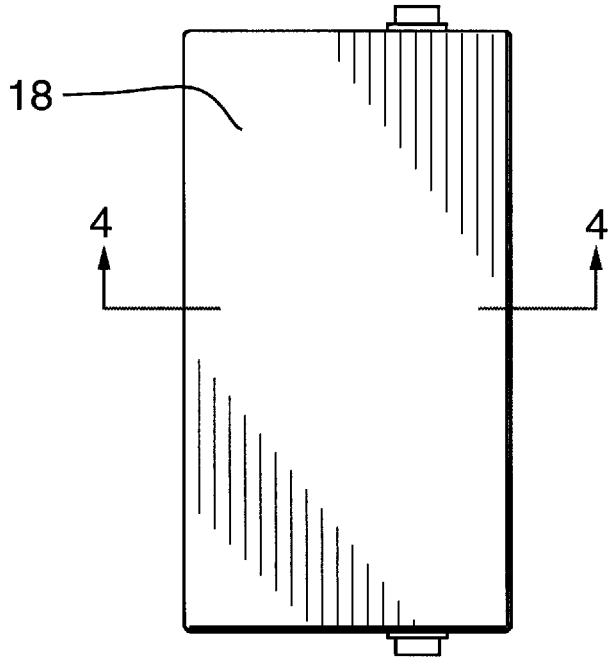
FIG. 5 is a plan view of a storage container.
Figure 6:
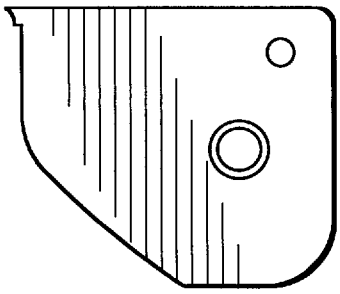
FIG. 6 is a side view of a storage container.

As best shown in FIGS. 4, 5, and 6, the storage containers have two identical parallel five-sided walls 17 which are joined by three generally rectangular faces 18 to form the container. The two remaining faces are open to provide access to the storage container. The storage containers are preferably molded from clear plastic to permit the user to examine the contents without opening the containers.

In the closed position, the faces of the storage containers form a single plane flush with the bottom surface of the box portion, as shown in FIG. 2, so that the bottom of the tool case can rest flat on a work surface when the user has opened the lid to access the tools in the panels.

FIG. 3 shows that each storage container is joined to the box portion by a male connection pin 25 which extends outwardly at a right angle from the two walls of each storage container. A corresponding recessed female connection means 26 adapted to receive the pins of each storage container is molded into both sides of the recess of the box portion adjacent to the walls of the containers. The pin of each storage container is inserted into the corresponding female connection means, such that the containers are prevented from falling out of the recess in the box portion, but are permitted to freely rotate. It is understood by one skilled in the art that other methods of pivotally connecting the storage containers to the box portion may be employed and are within the scope of the invention.

As best shown in FIG. 3, all of the storage containers are joined by two gang bars 30 to allow the containers to only move in unison. The gang bars are located in the space between the side walls of the storage containers and the sides of the recess. The gang bars are connected to the storage containers by protruding cylindrical male connections 31 located along their length which fit snugly into female openings 32 in the side walls of each storage container. It should be clear that only one gang bar could be employed.

Figure 7:
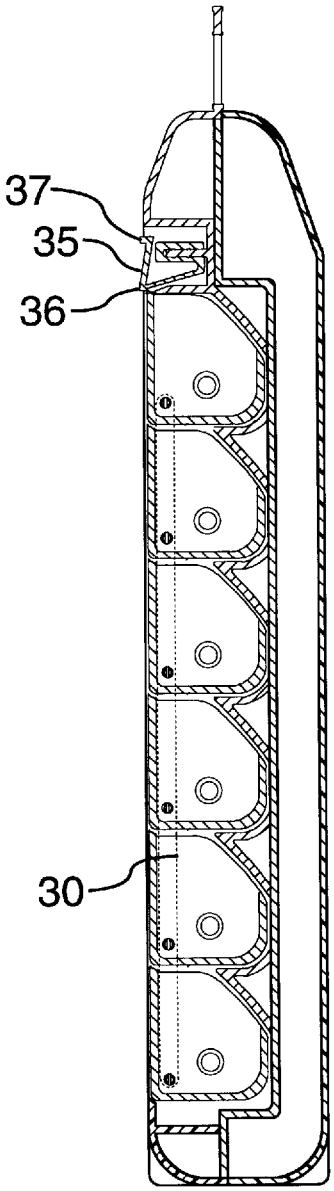
FIG. 7 is a cross-sectional view of the box portion and storage containers in the closed position along B—B in FIG. 2.
Figure 8:
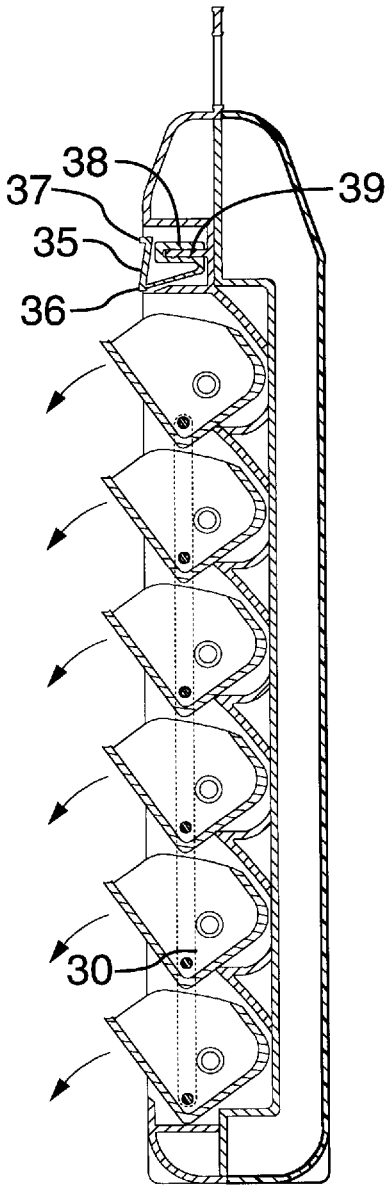
FIG. 8 is a cross-sectional view of the box portion and storage containers in the open position along B—B in FIG. 2.

The storage containers are prevented from freely rotating by a plastic clasp 35 molded from one piece of plastic, attached to the box portion and preferably located adjacent to the storage container closest to the handle. However, any other suitable means of securing the storage containers to the box portion may be used and such means would be within the scope of the invention. As best shown in FIG. 7, a section of the clasp 38 molded into an aperture is snapped by conventional means onto a co-operating plastic member 39 extending outwardly from the base. The clasp configuration includes a ridge 36 extending over the face of the storage container when it is in the closed position to secure the containers in the closed position. The clasp configuration also includes a catch 37 to permit the user to easily grasp the clasp configuration. To pivot the containers to the open position, the user grasps the catch and pulls it away from the storage containers lifting the ridge which extends over the adjacent storage container and restricts its rotation. The user can freely pivot the storage container adjacent to the clasp into an open position, and when he/she does so, he/she also moves the gang bar connected thereto, which gang bar then imparts the motion to all the other containers causing them to move in unison.

Figure 9:
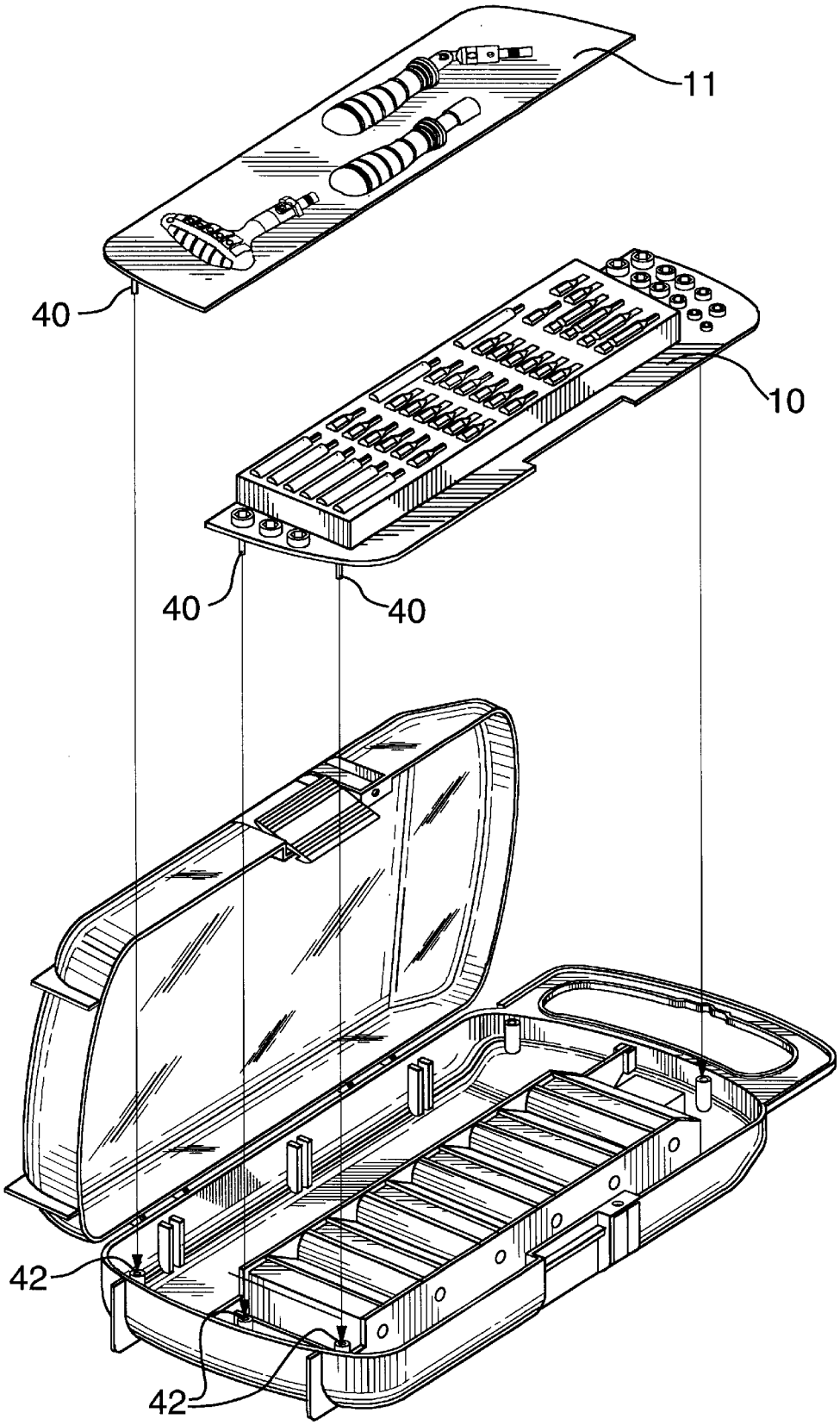
FIG. 9 is an exploded view of the top of the tool case.
Figure 10:
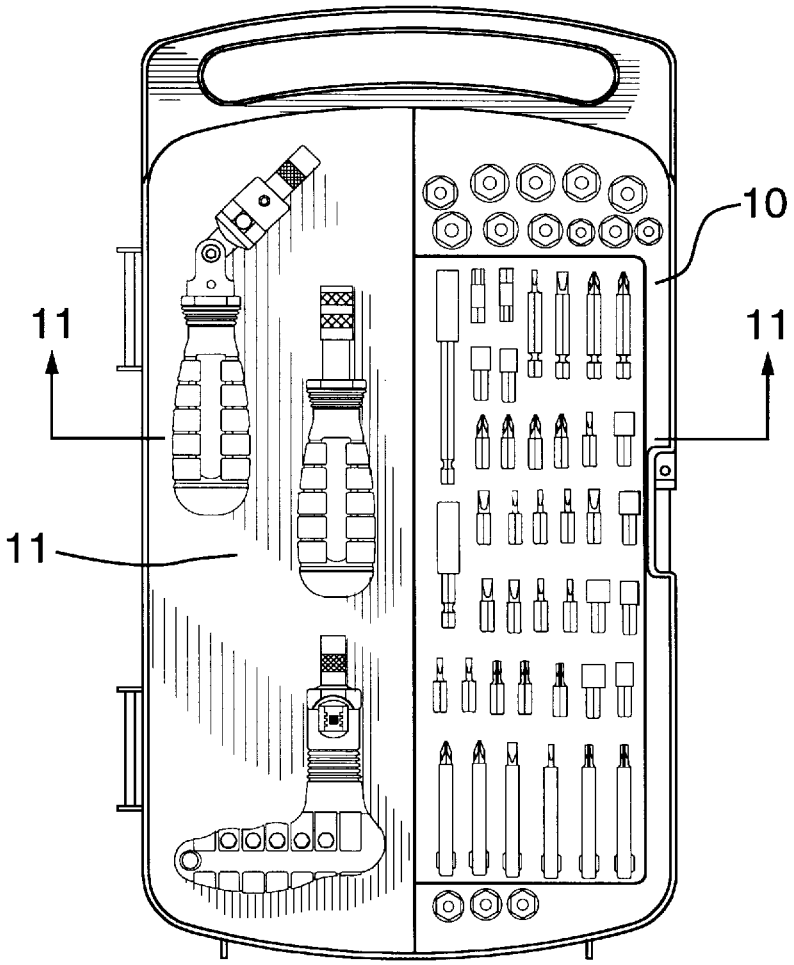
FIG. 10 is a plan view of the tool case with the lid removed.
Figure 11:
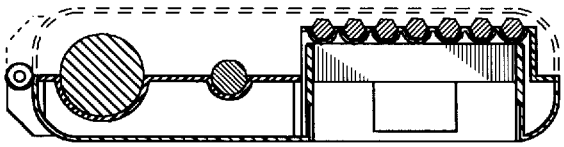
FIG. 11 is a cross-sectional view of the tool case along line C—C in FIG. 10.

In the preferred embodiment, a modular raised plastic panel 10 is mounted across a section of the box portion above the storage containers, as best shown in FIG. 9. The raised panel is recessed to accommodate components with little depth, such as screwdriver bits and sockets. A conventional modular plastic panel 11 mounted across the remaining section of the box portion and is recessed to house tools and other parts with substantial thickness. FIG. 10 shows one such configuration for a conventional panel and a raised panel, but many different configurations for the recesses in the panels are possible to accommodate different tools and different components for the tools.

The panels are preferably mounted in the box portion by inserting male connecting posts 40 into corresponding female receiving posts 42, as best shown in FIG. 9, although other methods of mounting the panels will be readily apparent to those skilled in the art.

It will be appreciated that the above description relates to the preferred embodiment by way of example only. Many variations on the invention will be obvious to those knowledgeable in the field, and such obvious variations are within the scope of the invention as described and claimed, whether or not expressly described.

Figure 12:
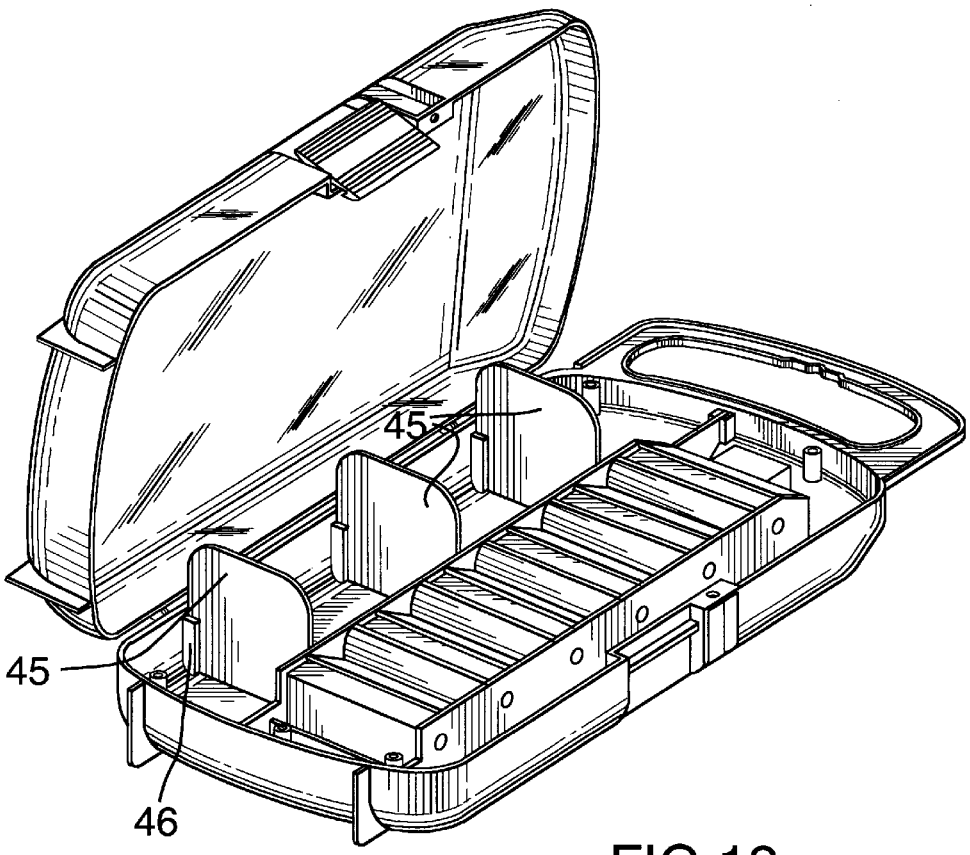
FIG. 12 is a perspective view of an alternative configuration of the tool case.
Figure 13:
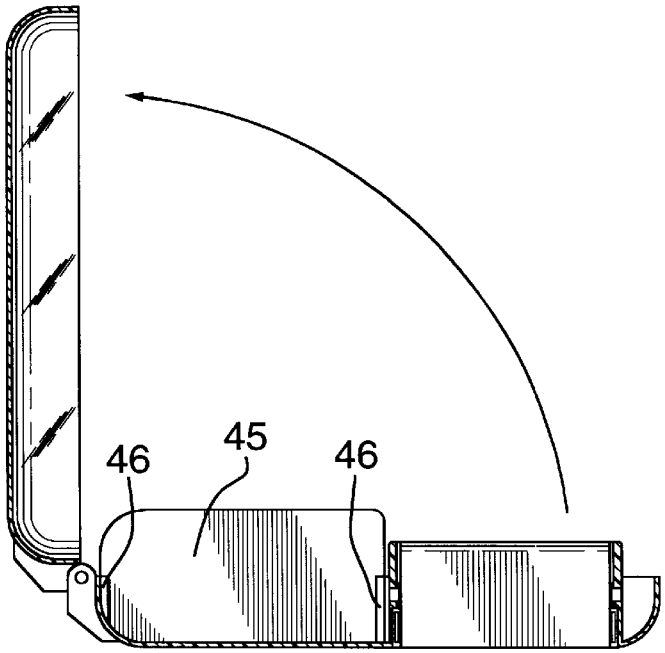
FIG. 13 is a cross-sectional view of the alternative configuration in FIG. 12.

FIGS. 12 and 13 show an alternative embodiment of the invention where the conventional panel described above is removed and, instead, dividers 45 are mounted within the box portion to create storage sections. The storage sections are created by inserting the dividers into matching molded slots 46 projecting upwardly from the bottom of the box portion. The height of the dividers is such that when the lid is in the closed position, the dividers are flush with the inside surface of the lid, thereby preventing items in one storage section from accidentally shifting to another section if, for example, the tool case is agitated. The raised panel (not shown) is mounted above the storage containers, as described previously.

It should be clear that alternative embodiments of the invention may be employed, such as locating two or more drop bin assemblies in the bottom surface of the box portion, or locating one large drop bin assembly covering most of the bottom surface.

What is claimed as the invention is:

1. A tool case with multiple storage compartments comprising:

a box portion;

a lid securable onto said box portion;

a recess defined in the bottom of said box portion;

a plurality of containers pivotably mounted inside said recess connected along at least one side by a gang bar, said containers configured to pivot between open and closed positions, such that in said closed position, an outer face of each said container is coplanar and flush with the bottom surface of said box portion, and in said open position, said outer face projects outwardly, exposing openings into said containers.

2. A tool case as defined in claim 1, further comprising a securing means for securely maintaining said containers in said closed position.

3. A tool case as defined in claim 2, where said securing means is a flexible clasp molded from a single piece of plastic configured to pivot relative to said box portion from a position where said clasp overlaps an edge of one of said containers, thereby securing them in said closed position, to a position not overlapping said edge, thereby releasing said containers.

4. A tool case as defined in claim 1, where said recess extends across less than one half of the surface area of the bottom of said box portion, such that the remaining portion of said box has greater space to accommodate tools with significant depth.

* * * * *